US005918398A

United States Patent [19]

Stanley et al.

[11] Patent Number: 5,918,398

[45] Date of Patent: Jul. 6, 1999

[54] CUSTOM DISPLAY SYSTEM

[76] Inventors: Kay L. Stanley; Curt D. Seymour, both of 6107 W. 128th St., Overland Park, Kans. 66209

[21] Appl. No.: 08/781,343

[22] Filed: Jan. 21, 1997

[51] Int. Cl.[6] ..... G09F 7/12

[52] U.S. Cl. ..... 40/594; 40/595; 40/618; 40/768; 40/769; 40/773

[58] Field of Search ..... 40/594, 595, 618, 40/630, 638, 661.09, 768, 769, 773, 777

[56] References Cited

U.S. PATENT DOCUMENTS

| | | | |
|---|---|---|---|
| 156,788 | 11/1874 | Hale . | |
| 187,704 | 2/1877 | Clare . | |
| 949,328 | 2/1910 | Milner . | |
| 1,376,677 | 5/1921 | Coufal . | |
| 1,770,803 | 7/1930 | Porstner et al. | 40/618 |
| 1,862,897 | 6/1932 | Klie . | |
| 1,870,221 | 8/1932 | Babcock | 40/618 |
| 1,877,919 | 9/1932 | Livingston | 40/618 |
| 2,093,264 | 9/1937 | Chernow | 40/618 |
| 2,195,042 | 3/1940 | Wishinsky | 40/618 |
| 2,586,039 | 2/1952 | Heggedal | 40/618 X |
| 2,828,567 | 4/1958 | Shoan . | |
| 2,844,901 | 7/1958 | Eisen . | |
| 2,871,601 | 2/1959 | Warnow . | |
| 3,063,338 | 11/1962 | Bregman . | |
| 3,079,715 | 3/1963 | Cross . | |
| 3,295,674 | 1/1967 | Shore . | |
| 3,338,395 | 8/1967 | Silverstein | 40/595 X |
| 3,402,495 | 9/1968 | Fishback | 40/595 X |
| 3,440,746 | 4/1969 | Richards | 40/595 |
| 3,440,750 | 4/1969 | Toth et al. . | |
| 3,626,616 | 12/1971 | Seme | 40/595 |
| 4,110,923 | 9/1978 | Shore . | |
| 4,340,976 | 7/1982 | Wright | 40/595 X |
| 4,356,649 | 11/1982 | Diamond et al. . | |
| 4,393,612 | 7/1983 | Clark . | |
| 4,736,536 | 4/1988 | Doman . | |
| 4,738,043 | 4/1988 | Ernst | 40/618 |
| 4,809,451 | 3/1989 | Suzuki . | |
| 4,991,336 | 2/1991 | Lucke . | |
| 5,025,579 | 6/1991 | Krueger . | |
| 5,361,521 | 11/1994 | Burtch . | |
| 5,419,589 | 5/1995 | Fattore . | |
| 5,483,762 | 1/1996 | Hogan . | |
| 5,787,626 | 8/1998 | Bingham et al. | 40/735 |

FOREIGN PATENT DOCUMENTS

| | | | |
|---|---|---|---|
| 1558538 | 2/1969 | France | 40/594 |

*Primary Examiner*—Brian K. Green
*Assistant Examiner*—Andrea Chop
*Attorney, Agent, or Firm*—Mark E. Brown; Litman, Kraai & Brown LLC

[57] ABSTRACT

A custom display system includes framing and display assemblies. The framing assembly includes a mat subassembly with mats having character string windows. The display assembly includes a display base with character units mounted thereon and forming a character string. The display base is attached to the mat subassembly for display through the character string window. Modified embodiment mats include one or more image windows. The custom display system can comprise a kit with a selection of character units for creating individualized character strings.

15 Claims, 5 Drawing Sheets

CUSTOM DISPLAY SYSTEM

BACKGROUND OF THE INVENTION

1. Field of the Invention

The present invention relates generally to display systems, and in particular to a display system for custom character strings formed from a selection of character units.

2. Description of the Related Art

Display devices and systems are commonly used for conveying information, decorating, entertaining and other related purposes. Dynamic display systems are capable of changing to communicate different information and images. Such changes are often initiated by changing input signals to the dynamic display systems. Such devices and systems include electronic displays, projected images and various types of interactive communication devices. Digital display devices, such as LCDs and LEDs, are extensively used in dynamically displaying the output of electronic equipment.

Many types of displays have sentimental or personal associations, such as various types of portraits. Family members and friends provide popular subjects for portraiture.

In view of the highly personalized nature of portraiture, it is often customized with unique framing and other display techniques. For example, various combinations of frames and mats can be employed to customize a display and to compliment the displayed images. Text is often displayed, either by itself or in combination with one or more images. For example, portraiture is often combined with the names of the persons depicted. Other text and images can be included to provide a display which conveys additional information.

Many prior art custom display systems suffer from the disadvantages of being expensive, inflexible and limited to operation by trained operators. There is a need for a low-cost system for creating custom displays without special training, tools or equipment. Such a system should provide a wide range of choices in display formats, character styles, frames, mat options and combinations of text and images. Ideally such a system could be adapted for point-of-purchase marketing in retail establishments. A person could select from different alphabets of various lettering styles only those characters needed to form a particular character string, such as a person's name. One or more mats could be chosen to achieve a desired customized appearance. Additional display subject matter, such as photographs, news clippings, announcements, etc., could be provided by the person assembling the custom display to provide a personalized quality.

Greeting cards are an example of a medium for conveying personal messages, and are particularly popular in connection with certain events and occasions. Interactive equipment has been devised for personalizing greeting cards with personal messages, artwork and other design features. However, such equipment is relatively expensive and can require a significant commitment of resources and floor space by a retailer. Moreover, the subject matter available with computerized greeting card printing equipment is often limited to graphics and text stored in the computer's memory, thus precluding the effective incorporation of such personalized memorabilia as photographs, announcements, news clippings, etc.

The present invention addresses some of the shortcomings of the prior art. Heretofore there has not been available a custom display system with the advantages and features of the present invention.

SUMMARY OF THE INVENTION

In the practice of the present invention, a custom display system is provided, which includes framing and display assemblies. The framing assembly includes a mat subassembly with front and back mats each having front and back faces and a character string window. A display assembly includes a base sheet having a display base with a grid printed thereon. The grid delineates character locations and half character locations. A plurality of character units are provided for forming character strings which can correspond to, for example, a person's name. The display base is mounted on the back face of the back mat with the character string displayed in the character string window. Modified embodiments of the custom display system include one or more image windows formed in the mat subassembly and one or more images fastened to the back face of the back mat for display through the image windows. The custom display system can comprise a kit with a character assortment corresponding to the alphabet and a variety of mat configurations.

OBJECTS AND ADVANTAGES OF THE INVENTION

The principle objects and advantages of the present invention include: providing a custom display system; providing such a system which provides different mat options; providing such a system which utilizes individual character units for forming character strings; providing such a system which provides different character unit options; providing such a system which accommodates different lengths of character strings in a mat character string window; providing such a system with mats including image windows; providing such a system which is easy to use without special training, tools or equipment; providing such a system which can produce a wide variety of custom displays; providing such a system which accommodates personalized display subject matter; providing such a system which can incorporate one or more personalized images in the display; providing such a system which can be offered as a kit; providing such a system which is well adapted for point-of-purchase sales in retail establishments; providing such a system which can offer a wide range of different character lettering styles, colors and other visual and aesthetic effects; and providing such a system which is economical to manufacture, efficient in operation, capable of a long operating life and particularly well adapted for the purposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
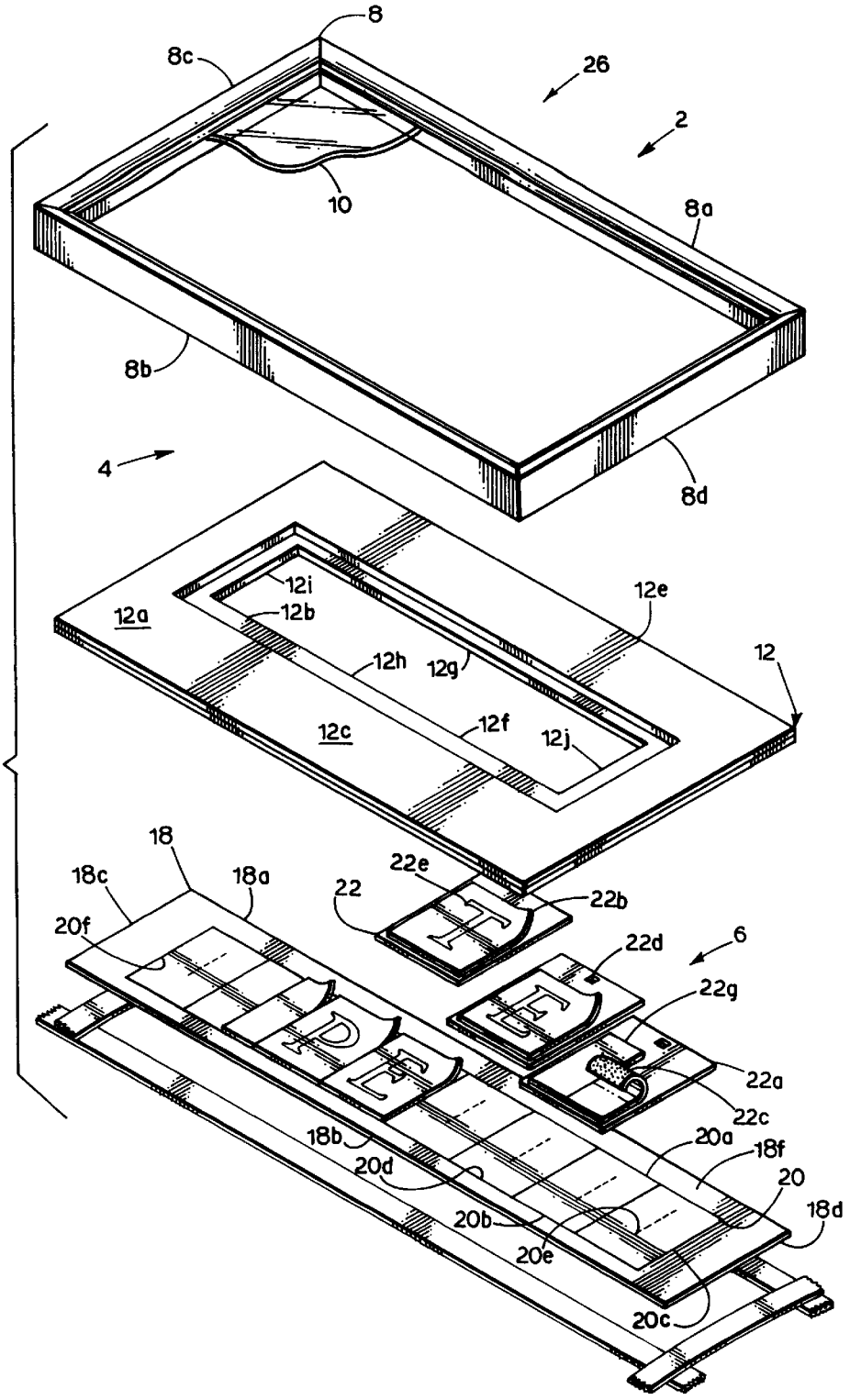
FIG. 1 is an upper, exploded perspective view of a custom display system, embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a custom display system embodying the present invention. The custom display system 2 generally comprises a framing assembly 4 and a display assembly 6.

II. Framing Assembly 4

The framing assembly 4 includes a frame 8 with upper, lower and opposite side rails 8*a,b,c,d* respectively. An optional glass or clear plastic glazing 10 can be mounted in the frame 8.

A mat subassembly 12 can comprise any suitable number of mats such as the inner and outer mats 12*a,b* which are shown. Each mat 12*a,b* includes inner and outer faces 12*c,d* and a mat perimeter 12*e*, which can be sized to fit in the frame 8. Each mat 12 also includes a character string window 12*f* with upper, lower and opposite side edges 12*g,h,i,j*. The window edges 12*g–j* be bevel cut as appropriate.

The components of the framing assembly 4 can assume a wide variety of configurations, shapes, sizes and materials as appropriate for desired visual appearances and aesthetic effects.

III. Display Assembly 6

The display assembly 6 includes a base sheet 14. The base sheet 14 (FIGS. 2 and 3) includes a selvage area 16 surrounding a display base 18 with upper, lower and opposite edges 18*a,b,c,d* respectively which are demarcated by a dashed cut line 18*e*. The display base 18 includes front and back faces 18*f,g*. A grid 20 is printed on the display base 18 in spaced relation within its edges 18*a–d*. The grid 20 has a generally rectangular configuration with upper and lower horizontal grid lines 20*a,b* and a plurality of vertical grid lines 20*c* extending between the horizontal grid lines 20*a,b* in spaced relation whereby a plurality of character locations 20*d* are formed and extend in juxtaposed relation horizontally across the display base 18 front face 18*f*. A plurality of half space dividers 20*e* are positioned in spaced relation approximately midway between respective pairs of vertical lines 20*c* and form a plurality of half character locations 18*f*.

A plurality of character subassemblies 22 are provided and each includes a character backing 22*a* adhesively mounting a character unit 22*b* thereon with a layer of releasable adhesive 22*c*. Each backing 22*a* can include an upper, centered aperture 22*d*.

Figure 2:
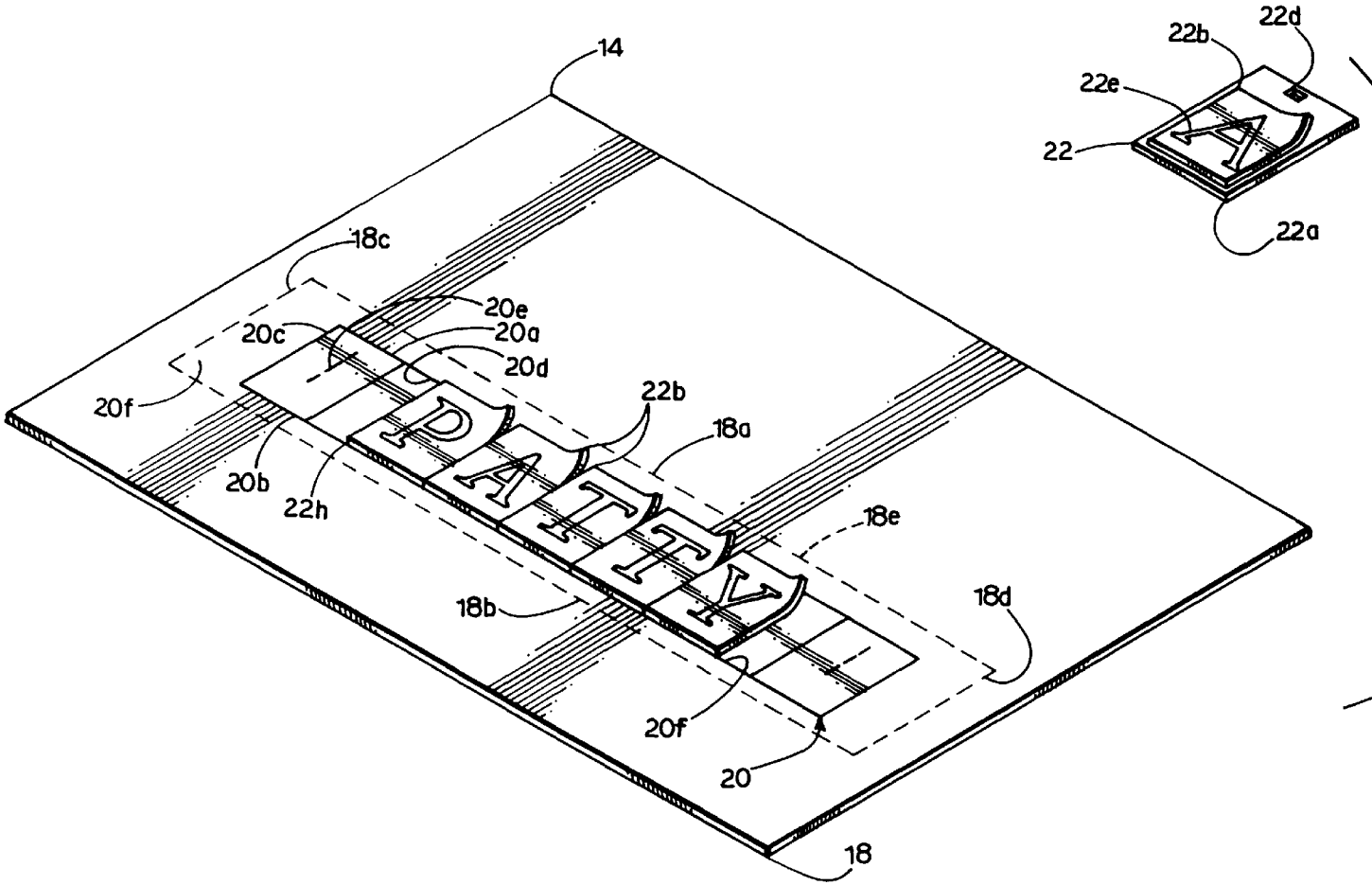
FIG. 2 is a fragmentary, upper, perspective view thereof, particularly showing a display subassembly.
Figure 3:
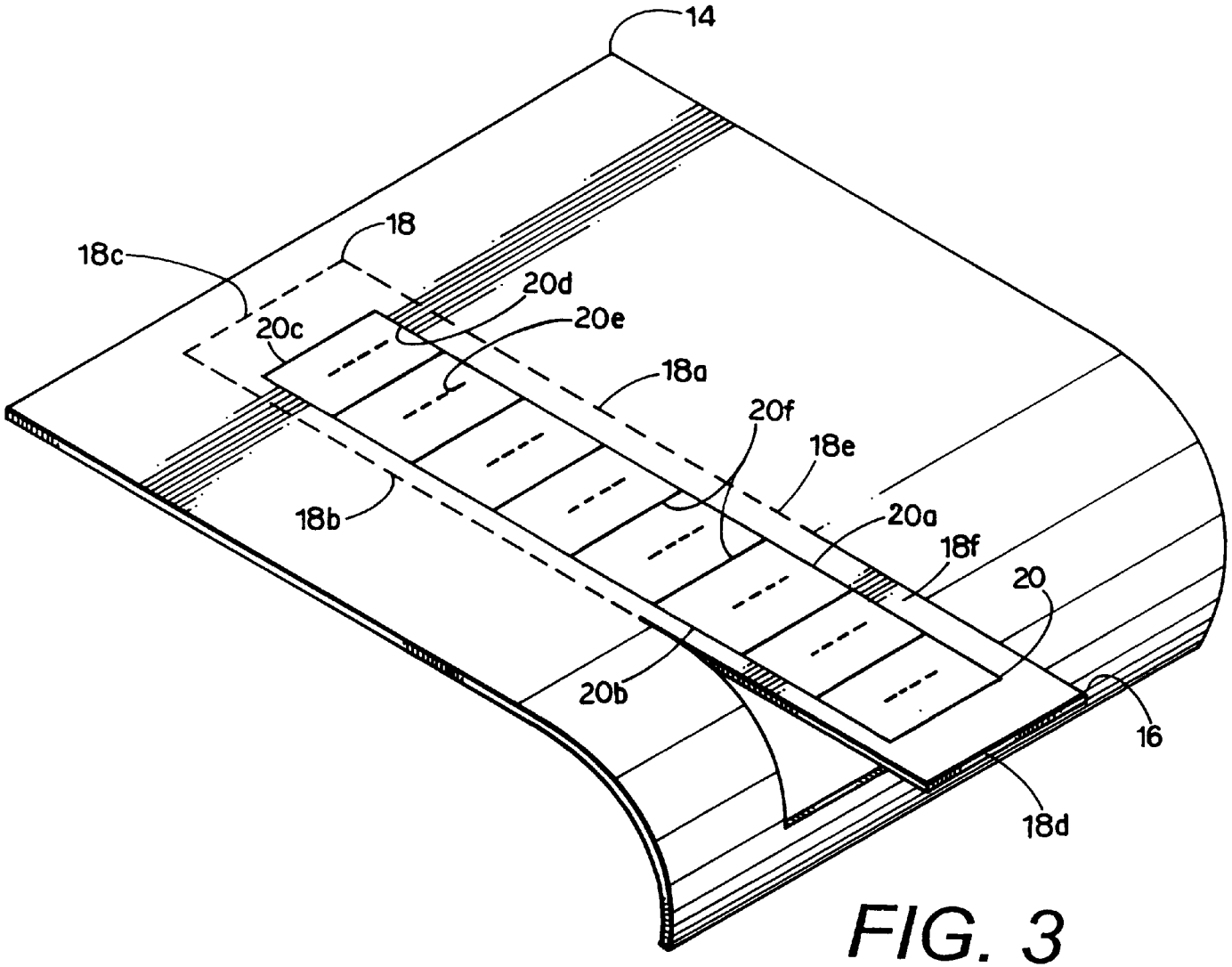
FIG. 3 is a fragmentary, perspective view thereof, particularly showing a display base being separated from a base sheet of the display subassembly thereof.
Figure 4:
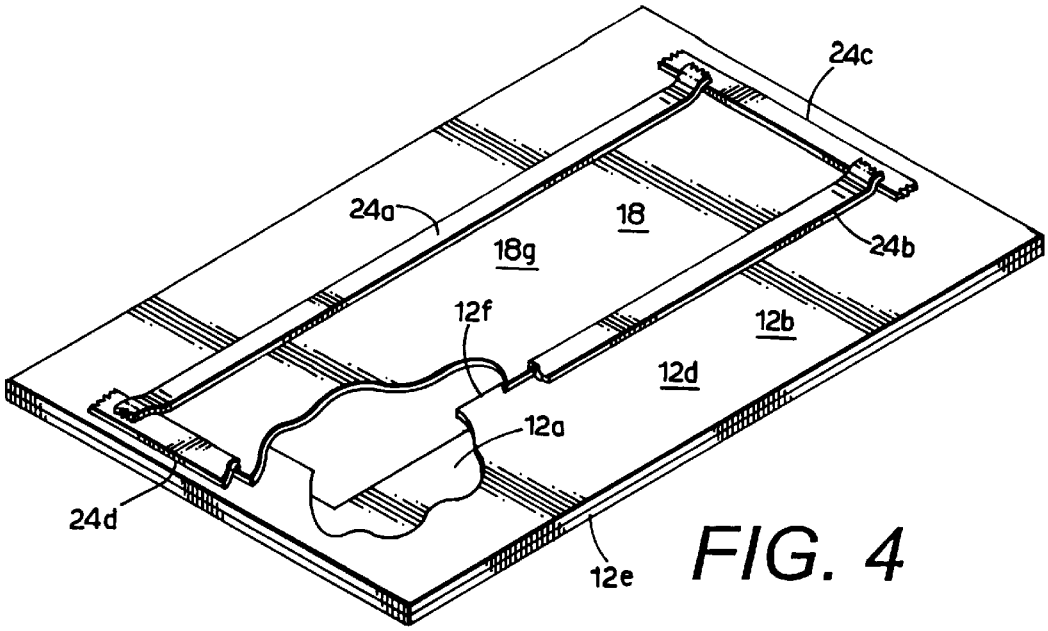
FIG. 4 is a fragmentary, bottom perspective view thereof, particularly showing the back face of a mat subassembly with the display subassembly mounted thereon.

The character units 22*b* are adapted to be peeled away from the backings 22*a* (FIG. 2) and applied in appropriate character locations 20*d* or 20*f* as appropriate by means of the adhesive 22*c*. The character units 22*d* can be imprinted with suitable characters 22*e*. Moreover, blank character units 22*f* and blank half units 22*g* are provided. A series of characters 22*e* and/or blank units 22*f,g* form characters strings 22*h* which can spell an appropriate word, e.g., a name such as "PATTY" (FIG. 2).

The character subassembly 22 is mounted on the inner face 12*c* of the inner mat 12*a* by suitable base sheet mounting means, such as tape strips 24*a–d*.

IV. Custom Display System Kit 26

The custom display system 2 can include a kit 26 for display and marketing purposes, for example at a retail location in a point-of-purchase display application. The kit 26 includes an assortment of individual character units 22*b* and different sizes of mats such as 12*a* or 12*b*, with different sizes and configurations of openings, for example, 12*f*.

V. Operation

In operation, the custom display system 2 is adapted for permitting the assembly of a wide variety of custom displays with character strings 22*h*, mat subassemblies 12, frames 8 and other components selected, formatted and arranged in various combinations. A character string 22*h* is determined, such as a person's name, and the appropriate character units 22*b* are selected to form the character string 22*h*.

A mat or mats, such as 12*a,b*, are selected based upon character string windows 12*f* of sufficient length to accommodate the selected character string 22*h*. For example, a five character string 22*h* would fill the window 12*f* of the inner mat 12*a*. To display a four character string (e.g., "PETE", FIG. 1), blank half units 22*g* are provided at each end of the character string 22*h*. The character units 22*b* are peeled from their respective backings 22*a* and adhesively secured in the character locations 20*d*. The half dividers 20*e* facilitate the positioning of the blank half units 22*g* in respective half character locations 22*f*. The five character string ("PATTY", FIG. 2) utilizes the half dividers 20*e* for locating the character units 22*b* in the center of the grid 20.

With the character units 22*b* installed on the base sheet 14, the selvage 16 can be cut away (FIG. 3) to leave the display base 18 for taping to the back face 12*c* of the inner mat 12*a* with the tape strips 24*a–d*. As an alternative to the tape strips 24*a–d*, the display base 18 can be fastened to the mat assembly 12 with other suitable adhesive means, such as a two-sided tape and adhesive.

The assembled mat subassembly 12 can be placed in a suitable frame 8 for display.

VI. First Modified Embodiment Custom Display System 102

Figure 5:
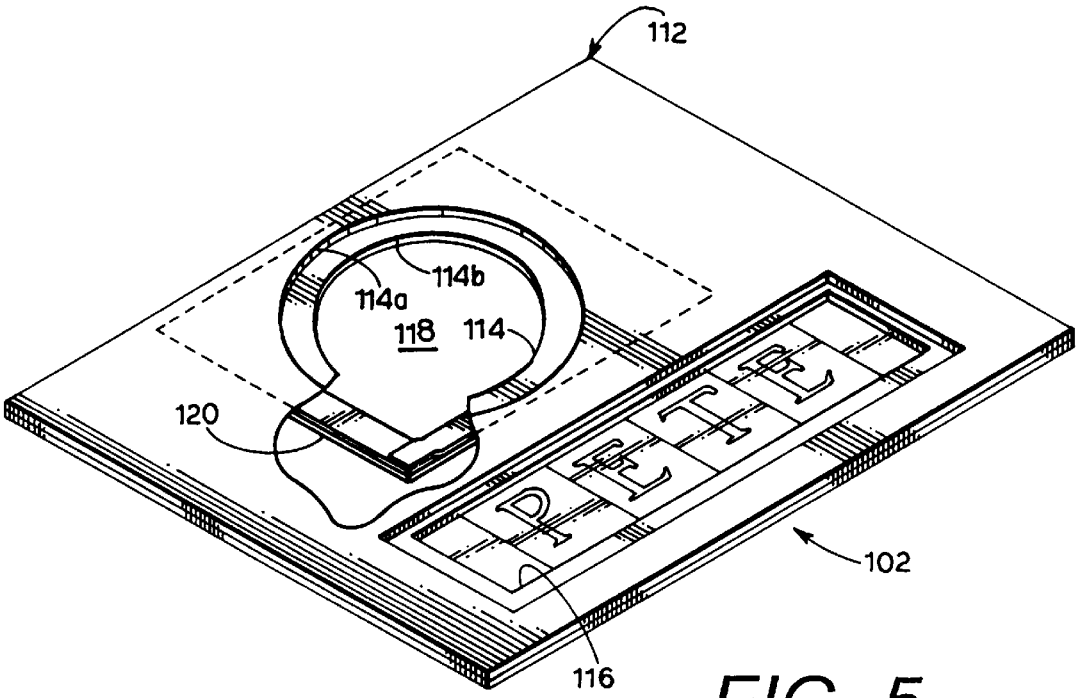
FIG. 5 is an upper perspective view of a custom display system comprising a first modified embodiment of the present invention with a center image window and a center image.

FIG. 5 shows a custom display system 102 with a modified mat subassembly 112 including a round image window 114 formed by front and back image window openings 114*a,b* and generally centered over a character string window 116. An image 118 is mounted on the back of the mat assembly 112 for viewing through the image window 114 by two-sided tape 120.

VII. Second Modified Embodiment Custom Display System 202

Figure 6:
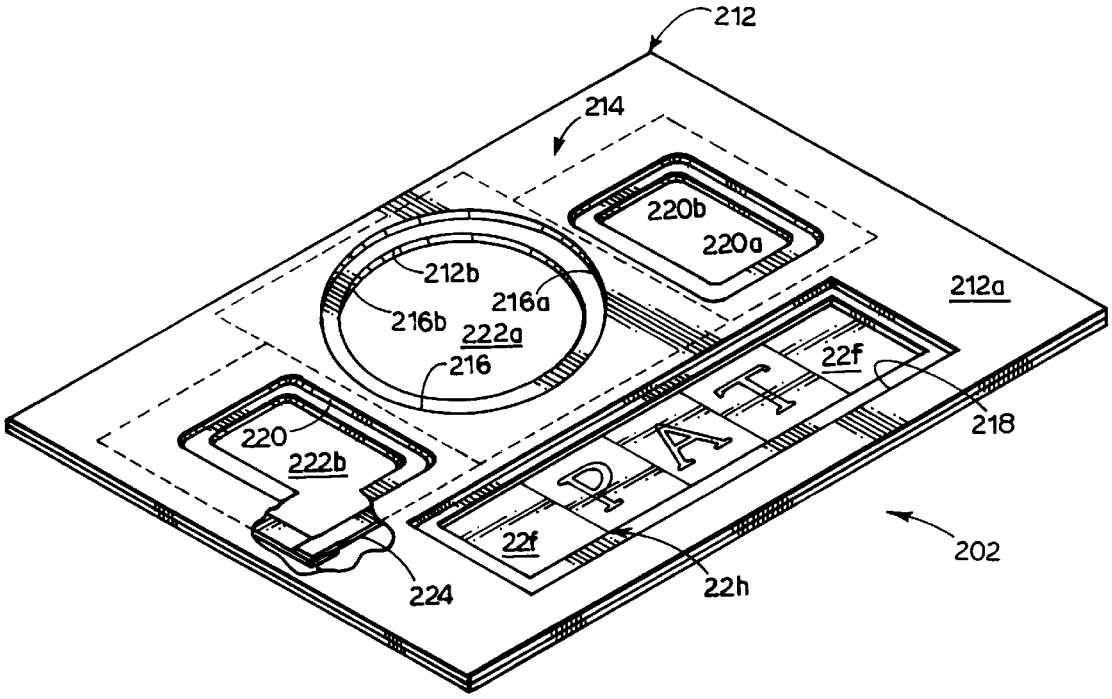
FIG. 6 is an upper perspective view of a custom display system comprising a second modified embodiment of the present invention with a center image window, two side image windows and center and side images mounted therebehind.

A custom display system 202 comprising a second modified embodiment of the present invention is shown in FIG. 6 and includes a modified mat subassembly 212 with an image window array 214 including a generally circular, center image window 216 generally centered over a character string window 218 and formed by front and back image window openings 216*a,b* in front and back mats 212*a,b* respectively. A pair of side image windows 220 are provided on each side of the center image window 216 and each comprises front and back image window openings 220*a,b* in the front and back mats 212*a,b* respectively. Center and side images 222*a,b* mounted on the back mat 212*a* by two-sided tape 224.

It will be appreciated that a wide variety of additional custom display systems can be devised which are in the scope of the present invention. For example, various lettering styles and characters could be utilized to form the character strings 22*h* and the finished custom display systems could be oriented vertically or horizontally. Moreover, various numbers and configurations of image and character string windows could be formed in the mat subassemblies and could assume other geometric shapes, including ovals, diamonds, polygons, etc.

It is to be understood that while certain forms of the present invention have been illustrated and described herein, it is not to be limited to the specific forms or arrangement of parts described and shown.

What is claimed and desired to be secured by Letters Patent is as follows:

1. A custom display system, which comprises:

(a) a mat having front and back surfaces and a character string opening with opposite side margins and upper and lower margins;

(b) a base sheet;

(c) a character string comprising a plurality of character units each having a generally rectangular configuration with a height and a width and a character printed thereon;

(d) repositionable adhesive fastening means for fastening said character units on said base sheet in a character string configuration corresponding to said character string opening;

(e) base sheet mounting means for mounting said base sheet on said mat back surface with said character string located in said character string opening and visible from said mat front surface; and (f) said base sheet including a guide grid printed thereon and receiving the character string, said guide grid being adapted for locating said character units on said base sheet, said grid including upper and lower horizontal lines extending in substantially parallel relation and a plurality of substantially parallel vertical lines extending between and perpendicular to said horizontal lines.

2. The invention according to claim 1, which includes:

(a) a blank spacer unit generally corresponding in height and width to said character units.

3. The invention according to claim 1, which includes:

(a) a pair of half spacer units with heights corresponding to the heights of said character units and with widths of approximately one-half the widths of said character units.

4. The invention according to claim 1, wherein said guide grid includes:

(a) a plurality of half space lines each extending vertically between and parallel to a respective pair of vertical guidelines and located approximately midway therebetween.

5. The invention according to claim 4, which includes:

(a) said guide grid forming a generally rectangular grid with a height and a width corresponding to the height and width of said character string.

6. The invention according to claim 1, which includes:

(a) a kit comprising a plurality of said mats with different-sized said windows and a plurality of said character units corresponding to the characters of the alphabet and full and half-size spacer units.

7. The invention according to claim 1, wherein:

(a) said fastening means comprises adhesive on the backs of said character units.

8. The invention according to claim 1, which includes:

(a) an image window formed in said mat; and (b) an image mounted on said base sheet and visible in said image windows.

9. The invention according to claim 8, which includes:

(a) said image window having a generally circular configuration and being generally centered over said character string opening.

10. The invention according to claim 8, which includes:

(a) said image window comprising a center first image window generally centered on said mat;

(b) first and second side image windows located on each side of said center image window; and (c) first and second side images each mounted on said mat behind said first and second side image windows respectively.

11. A custom display system, which includes:

(a) a mat including:

(1) front and back faces;

(2) upper, lower and opposite side edges;

(3) a character string window having upper, lower and opposite side edges; and (4) an image window located generally centered above said character string window;

(b) a display base including front and back faces and an alignment grid printed on the front face thereof, said alignment grid including:

(1) upper and lower horizontal guidelines extending in generally parallel, spaced relation;

(2) a plurality of vertical guidelines extending between said horizontal guidelines in parallel, spaced relation;

(3) a plurality of intermediate vertical guidelines each located approximately midway between and generally parallel to a respective pair of vertical guidelines;

(4) a plurality of character location s each formed between a respective pair of vertical guidelines;

(5) a plurality of half character locations each formed between a respective intermediate vertical guideline and a respective vertical guideline;

(6) a plurality of character units each located in one of a respective character location and a pair of adjacent half character locations, each character unit having a character imprinted thereon; and (7) said characters forming a character string;

(c) fastening means for fastening said character units to said display base comprising adhesive applied to said character units;

(d) a plurality of tape strips attached to said display base and to said mat back face, said tape strips attaching said display base to said mat back face with said character string visible in said character string window; and (e) an image mounted on said mat back face and visible in said image window.

12. A custom display system, which includes:

(a) a framing assembly including:

(1) at least one front mat and at least one back mat, said front mat being mounted on said back mat;

(2) each mat including front and back faces; and (3) each mat including a character string window;

(b) a display assembly including:

(1) a base sheet with a display base, a selvage area around said display base and a cutline demarcating said display base and said selvage area;

(2) a grid printed on said display base and including upper and lower horizontal lines extending in generally parallel relation, a plurality of vertical lines extending between said horizontal lines in generally parallel, spaced relation;

(3) a plurality of intermediate divider lines each located between a respective pair of vertical lines;

(4) a plurality of character locations each bounded by said horizontal lines and an adjacent pair of vertical lines;

(5) a plurality of half character locations each bounded by said horizontal lines, a vertical line and an intermediate divider line;

(6) a plurality of character subassemblies each including a backing, a character unit and an adhesive layer on said character unit releasably connecting same to said backing;

(7) a plurality of said character subassemblies having characters printed on said character units;

(8) a plurality of said character units comprising blank units without characters printed thereon;

(9) said character units having heights and widths corresponding respectively to the heights and widths of said character locations;

(10) a plurality of said character units comprising blank half units having heights and widths corresponding respectively with heights and widths of said half character locations;

(11) said character units being mounted on said character locations and forming a character string on said display base; and

(12) a plurality of tape strips attaching said display base to said back face of said back mat with said character string displayed in said character window.

13. The custom display system according to claim 12, which includes:

(a) said custom display comprising a plurality of mats and a selection of characters subassemblies with characters corresponding to the alphabet.

14. The custom display system according to claim 12, which includes:

(a) said mats having image windows formed therein; and (b) a plurality of images, each being mounted on said back face of said back mat and visible through a corresponding said image window.

15. The custom display system according to claim 14, which includes:

(a) said image windows comprising center image windows generally centered on said mats over said character string windows;

(b) each said mat including first and second side image windows located on each side of said center image windows;

(c) a plurality of said images comprising center images; and (d) first and second side images each mounted on said back face of said back mat behind said first and second side image windows respectively.

* * * * *